United States Patent [19]

Hayashi

[11] Patent Number: 4,465,041

[45] Date of Patent: Aug. 14, 1984

[54] CYLINDER BLOCK OF INTERNAL COMBUSTION ENGINE

[75] Inventor: Yoshimasa Hayashi, Kamakura, Japan

[73] Assignee: Nissan Motor Company, Limited, Yokohama, Japan

[21] Appl. No.: 324,149

[22] Filed: Nov. 23, 1981

[30] Foreign Application Priority Data

Nov. 26, 1980 [JP] Japan ..... 55-168242[U]

[51] Int. Cl.[3] ..... F02F 7/00

[52] U.S. Cl. ..... 123/195 R; 123/195 H

[58] Field of Search ..... 123/195 R, 195 C, 195 H, 123/195 S, 198 E

[56] References Cited

U.S. PATENT DOCUMENTS

| | | | |
|---|---|---|---|
| 2,098,451 | 11/1937 | Gilmore | 123/195 R |
| 2,653,586 | 9/1953 | Nallinger | 123/195 R |
| 3,046,954 | 7/1962 | Hoffman et al. | 123/195 H |
| 4,219,002 | 8/1980 | Danckert et al. | 123/195 C |

FOREIGN PATENT DOCUMENTS

| | | |
|---|---|---|
| 2803763 | 8/1979 | Fed. Rep. of Germany . |
| 455258 | 7/1913 | France . |
| 2008195 | 5/1979 | United Kingdom . |

*Primary Examiner*—Craig R. Feinberg

*Attorney, Agent, or Firm*—Schwartz, Jeffery, Schwaab, Mack, Blumenthal & Koch

[57] ABSTRACT

A cylinder block of an internal combustion engine, comprises a plurality of main bearing bulkheads, two oppositely disposed oil pan installation flange portions which are integral with the bearing bulkheads and made of a light alloy same as the bearing bulkheads, and a reinforcement member cast in and embedded throughout each oil pan installation flange portion and each main bearing bulkhead bottom section, the material of said reinforcement member being different from and high in mechanical strength than the light alloy, thereby greatly improving the rigidity of each bearing bulkhead bottom section to prevent each bearing bulkhead bottom section from vibrating.

6 Claims, 4 Drawing Figures

CYLINDER BLOCK OF INTERNAL COMBUSTION ENGINE

BACKGROUND OF THE INVENTION

1. Field of the Invention

This invention relates to an improvement in a cylinder block of an internal combustion engine, made of a light alloy.

2. Description of the Prior Art

In connection with automotive internal combustion engines, a cylinder block of the engine has conventionally been made of cast iron in order to obtain sufficient mechanical strength. However, such a cast iron-made cylinder block is heavy in weight and contrary to weight-lightening of the engine which is necessary particularly for the purpose of fuel economy. Accordingly, light alloy-made cylinder blocks, whose parent material is a light metal such as aluminium, have recently been employed.

Such a light alloy-made cylinder block is light in weight; however, it tends partially to be insufficient in mechanical strength, particularly, in main bearing bulkheads to which main bearing caps are installed. As a result, each bearing cap readily vibrates in forward and rearward directions thereof by which the bearing cap may come down. This vibration induces the vibration of a cylinder block skirt section which is integrally connected to the main bearing bulkheads, which vibration causes the skirt section to move inward and outward so as to flap. Furthermore, the vibration of the skirt section can be transmitted also to an oil pan which is securely connected to the cylinder block skirt section. Thus, considerable vibration noise is generated in and radiated from the cylinder block skirt section and the oil pan.

BRIEF SUMMARY OF THE INVENTION

According to the present invention, a cylinder block of an internal combustion engine, comprises a plurality of main bearing bulkheads each having a bottom section to which a main bearing cap is fastened. Two oppositely disposed oil pan installation flange sections are integral with the bearing bulkheads and made of the same light alloy as the bearing bulkheads. A reinforcement member is cast in and embedded throughout each oil pan installation flange section and each bearing bulkhead bottom section. The material of the reinforcement member is different from and higher in mechanical strength than the above-mentioned light alloy. With this configuration, the cylinder block can obtain a rigidity enough to suppress the vibration thereof in forward and rearward directions though it is made of the light alloy, and accordingly to suppress the vibration of the cylinder block skirt section and the oil pan, thereby greatly lowering total engine noise level.

BRIEF DESCRIPTION OF THE DRAWINGS

The feature and advantages of the cylinder block according to the present invention will be more apparent from the following description taken in conjunction with the accompanying drawings in which like reference numerals designate corresponding parts and elements, and in which.

DETAILED DESCRIPTION OF THE DRAWINGS

Figure 1:
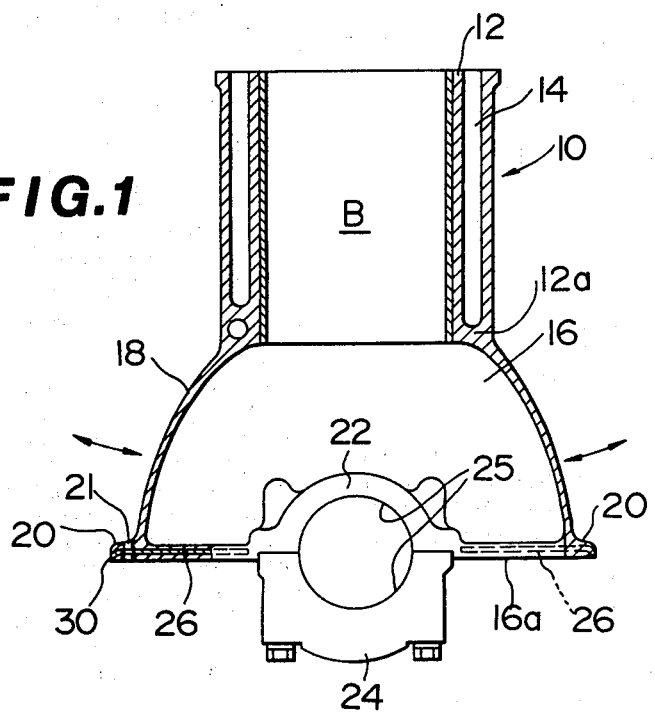
FIG. 1 is a vertical cross-sectional view of an embodiment of a cylinder block provided with main bearing caps, in accordance with the present invention.
Figure 2:
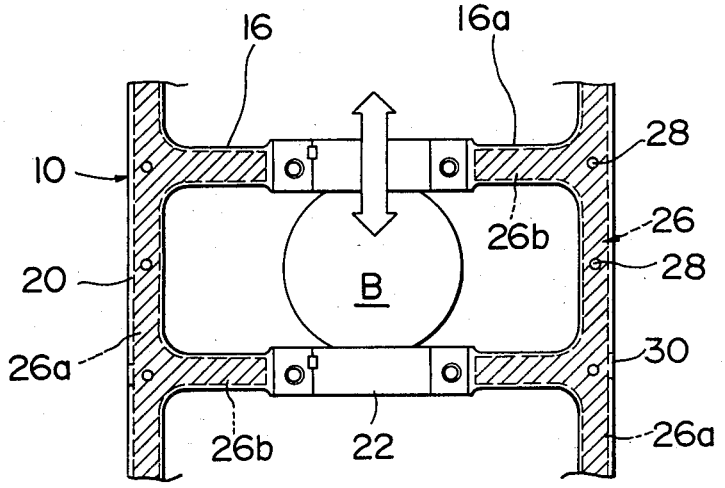
FIG. 2 is a fragmentary bottom plan view of the cylinder block of FIG. 1.
Figure 3:
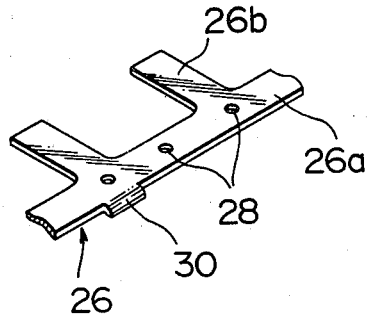
FIG. 3 is a fragmentary perspective view of a reinforcement member employed in the cylinder block of FIG. 1.

Referring now to FIGS. 1 to 4, particularly to FIGS. 1, 2 and 3, there is shown a preferred embodiment of a cylinder block 10 according to the present invention, of an internal combustion engine, for example, in use for an automotive vehicle. The cylinder block 10 is made of a light alloy such as aluminium alloy. In other words, the parent material of the cylinder block 10 is a light metal such as aluminium. The cylinder block 10 comprises, as usual, a plurality of engine cylinder sections 12 each of which is formed therein with a cylinder bore B in which a piston (not shown) will be movably disposed. A water jacket 14 is formed around the cylinder sections 12. In this instance, the cylinder block 10 is not provided with a so-called upper block deck and accordingly the water jacket 14 opens through the top surface of the cylinder block 10 to which top surface a cylinder head (not shown) will be fastened.

A plurality of main bearing bulkheads 16 are connected integrally to the cylinder sections 12 through a lower block deck 12*a*, and disposed vertically relative to the cylinder block and parallel with each other. Each bulkhead 16 is integrally connected at its opposite side sections to a skirt section 18 which is integrally connected to the cylinder sections through the block deck 12*a*, which skirt section is bulged outwardly to form thereinside a space forming part of a crankcase. Accordingly, the bearing bulkheads 16 serve as partition walls which separate the crankcase space into a plurality of chambers for respective cylinder sections 12. The skirt section 18 is formed at its bottom section with two oppositely disposed flange portions 20 to which an oil pan (not shown) will be fastened. Each flange portion 20 has a plurality of through-holes 21 for oil pan installation bolts (not shown). Each bulkhead 16 is formed, at its bottom section (16*a*) central part, a semicylindrical main bearing supporting section 22 to which a main bearing cap 24 is fastened to form a cylindrical main bearing housing 25 to support a main bearing (not shown) therein. In this instance, the bottom surface of the oil pan installation flange portion 20 of the skirt section 18 is in generally straight alignment with the bottom surface of the bottom section 16*a* of the bearing bulkhead 16.

A plate-like reinforcement member 26 is cast in or embedded in the bottom section of the cylinder block 10 so as to extend throughout the skirt section flange portion 20 and the bearing bulkhead bottom section 16*a*, by means of a so-called cast-in insert. The reinforcement member 26 is formed, for example, of a mild steel plate, a laminated plate constituted by firmly piling up a plurality of mild steel sheets by using spot-welding, or a cast iron plate. The reinforcement member 26 is positioned generally horizontally relative to the cylinder block and parallel with the bottom surfaces of the skirt section flange portion 20 and the bearing bulkhead bottom section 16*a*. As shown, the reinforcement member 26 has two opposite long sections 26*a*, and a plurality of short sections 26b. Each long section 26a is positioned in the skirt section flange portion 20 and extends generally throughout the flange 20. Each short section 26b is positioned in the bearing bulkhead bottom section 16a and so extends that its tip portion approaches the bearing support section 22. The long section 26a of the reinforcement member 26 is formed with a plurality of through-holes 28 which correspond to the through-holes 21 of the skirt section flange portion 20, the oil pan installation bolts passing through the holes 28. As shown in FIGS. 2 and 3, the reinforcement member 26 is further formed with a plurality of locaters 30 for suitably locating the reinforcement member in position during casting. Each locater 30 is formed along the outer side edge of each long section 26a of the reinforcement member 26.

It is preferable to so form the reinforcement member 26 that the hole 28 thereof is larger in diameter than the hole 21 of the skirt section flange 20, by which the molten cylinder block materials located on and under the reinforcement member 26 connect or become integral with each other through the periphery of each hole during casting-in, thereby further ensuring the cast-in insert of the reinforcement member 26 in the cylinder block 10.

It will be appreciated that the reinforcement member 26 increases the rigidity of each bearing bulkhead 16 in the direction of the axis of the cylinder block, thereby greatly reducing the vibration of each bearing bulkhead in the cylinder block axis direction.

With the thus arranged cylinder block 10, although each bearing bulkhead 16 is integrally connected at its upper section with the lower block deck 12a and at its opposite side sections to the skirt section 18, its bottom section 16a to which each bearing cap 24 is fastened constitutes a free end. Therefore, the bottom section 16a of the bearing bulkhead 16 seems to tend to readily vibrate in the direction of an arrow indicated in FIG. 2. However, by virtue of the reinforcement member 26 cast in throughout the skirt section flange portion 20 and the bearing bulkhead bottom section 16a, the rigidity in the above-mentioned direction is increased, so that the natural frequency of each bearing bulkhead with the bearing cap 24 becomes within a harmless high frequency range. In this connection, in a conventional cylinder block arrangement not provided with the reinforcement member 26, the natural frequency of each bearing bulkhead is within a range around 1 KHz, the noise due to such frequencies being particularly severe in various engine noises. Additionally, the velocity amplitude of the bearing bulkhead natural frequency can be decreased under the action of the reinforcement member 26, thereby greatly reducing cylinder block noises due to the inward and outward movement of the skirt section 18 indicated by arrows in FIG. 1, oil pan vibration and the like. Furthermore, if each bearing cap 24 is made of a light alloy, not of cast iron, the mass added to the bearing bulkhead 16 becomes less as compared with the case of cast iron. This increases the natural frequency of the bearing bulkhead 16, thereby further reducing noise level.

Figure 4:
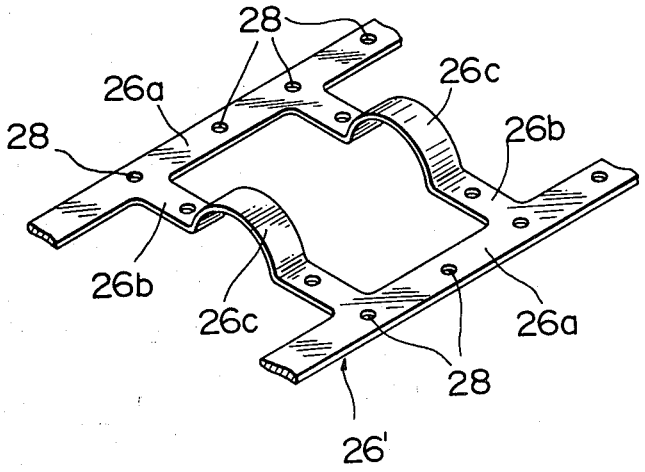
FIG. 4 is a fragmentary perspective view of another example of the reinforcement member to be employed in the cylinder block according to the present invention.

FIG. 4 shows another example of the reinforcement member 26' in which the two opposite short sections 26b disposed in the bearing bulkhead bottom section 16a are integrally connected with each other through a semicylindrical section 26c. The semicylindrical section 26c is disposed or embedded in the bearing support section 22 of the bearing bulkhead 16. With this arrangement, the cylinder block 10 can be improved in lateral flexural rigidity, thereby further improving the noise reduction effect due to the arrangement according to the present invention.

As appreciated from the above, according to the present invention, the bearing bulkhead bottom section can be improved in its rigidity in forward and rearward directions, so that the natural frequency of each bearing bulkhead shifts to a high frequency side as compared with in a conventional arrangement without the reinforcement member. This decreases the vibration levels of the cylinder block skirt section and the oil pan, caused by the bearing bulkhead forward and rearward direction vibrations, thereby greatly lowering the noise level of the cylinder block whose parent material is a light metal.

What is claimed is:

1. A cylinder block of an internal combustion engine, comprising:

a plurality of main bearing bulkheads, each having a bottom section to which a main bearing cap is fastened, said main bearing bulkheads being made of a light alloy;

two oppositely disposed oil pan installation flange portions adapted for attachment of an oil pan, said oil pan installation flange portions being integral with said bearing bulkheads and made of the same light alloy as said bearing bulkheads, said oil pan installation flange portions being positioned at a bottom section of said cylinder block; and a reinforcement member cast in and embedded throughout each oil pan installation flange portion and each bearing bulkhead bottom section, the material of said reinforcement member being different from and higher in mechanical strength than said light alloy, said reinforcement member including first sections, each of which is cast in and embedded along in one of said oil pan installation flange portions, and second sections, each of which is cast in and embedded along in one of said bearing bulkhead bottom sections, said reinforcement member first sections being integral with said reinforcement member second sections.

2. A cylinder block as claimed in claim 1, wherein said reinforcement member comprises a plate, and said first sections comprise two oppositely disposed parallel long sections which are positioned respectively in said two oil pan installation flange portions, and said second sections comprise a plurality of short sections, each of which is positioned in a bottom section of one of said bearing bulkheads.

3. A cylinder block as claimed in claim 2, wherein said reinforcement member is formed at each long section with a plurality of through-holes whose locations correspond respectively to a plurality of through-holes formed at each oil pan installation flange portion, the diameter of each through-hole of said reinforcement long section is larger than that of each through-hole of said oil pan installation flange portion.

4. A cylinder block as claimed in claim 2, wherein the bottom surface of each oil pan installation flange portion is in a common plane with the bottom surface of said bearing bulkhead bottom section, and in which each long section of said reinforcement member is in a common plane with each short section of the same.

5. A cylinder block as claimed in claim 4, wherein said bearing bulkhead bottom section is formed at a central portion with a semicylindrical main bearing support section which forms part of a cylindrical main bearing support housing, in which each pair of said reinforcement short sections are oppositely disposed in each bearing bulkhead bottom section and extend to said main bearing support section.

6. A cylinder block as claimed in claim 5, wherein said reinforcement member further includes a semicylindrical section integrally connecting the oppositely disposed short sections of said reinforcement member, said semicylindrical section being disposed in said main bearing support section of said bearing bulkhead.

* * * * *